US006390825B1

(12) United States Patent
Handley et al.

(10) Patent No.: US 6,390,825 B1
(45) Date of Patent: May 21, 2002

(54) ASSEMBLY INCLUDING AN ELECTRICAL CONNECTOR AND A PAIR OF PRINTED CIRCUIT BOARDS

(75) Inventors: James O. Handley; Jeffrey C. Murphy, both of Thousand Oaks, CA (US)

(73) Assignee: Trompeter Electronics, Inc., Westlake Village, CA (US)

( * ) Notice: Subject to any disclaimer, the term of this patent is extended or adjusted under 35 U.S.C. 154(b) by 0 days.

(21) Appl. No.: 09/599,092

(22) Filed: Jun. 21, 2000

(51) Int. Cl.[7] ..... H01R 12/00
(52) U.S. Cl. ..... 439/63; 439/581
(58) Field of Search ..... 439/63, 675, 78, 439/79, 65, 75, 544, 547

(56) References Cited

U.S. PATENT DOCUMENTS 5,624,278 A * 4/1997 Kuroda et al. ..... 439/675
5,904,578 A * 5/1999 Kubota et al. ..... 439/63
6,152,743 A * 11/2000 Fox ..... 439/63
6,164,977 A * 12/2000 Lester ..... 439/63

* cited by examiner

*Primary Examiner*—P. Austin Bradley
*Assistant Examiner*—Alexander Gilman
(74) *Attorney, Agent, or Firm*—Fulwider Patton, et al.; Ellsworth R. Roston

(57) ABSTRACT

An electrical connector includes a conductive casing and a conductive probe disposed within the casing. The probe may be in a concentric relationship with the casing. The probe is insulated from the casing as by a first insulating sleeve which may be disposed in a concentric relationship with the casing and the probe. A first electrical assembly such as a first printed circuit board has an opening for a disposition of the casing in the opening in the board in an insulated relationship with the board. A first end of the probe may pass through an opening in the first sleeve for connection to a terminal external to the connector. A second end of the probe may pass through an opening in a second insulating sleeve disposed in the casing and then may pass through an opening in a second electrical assembly such as a second printed circuit board in an insulated relationship to the casing. A plug may be disposed within the casing to position the second insulator fixedly within the casing. One of the boards may be a motherboard and the other board may be a daughterboard. One of the boards may be disposed in a transverse relationship to the other board.

6 Claims, 2 Drawing Sheets

ASSEMBLY INCLUDING AN ELECTRICAL CONNECTOR AND A PAIR OF PRINTED CIRCUIT BOARDS

This invention relates to a connector assembly. More particularly, the invention relates to a connector assembly which includes a casing and a probe disposed in an insulated and concentric relationship with the casing and which includes first and second printed circuit boards having a particular relationship to the casing and the probe in the connector to define an assembly with the electrical connector. One of the printed circuit boards may be a motherboard and the other printed circuit board may be a daughterboard.

BACKGROUND OF THE PREFERRED EMBODIMENT OF THE INVENTION

Integrated circuit chips are progressively decreasing in size as the thickness of the electrical lines in the chips progressively decrease in size. For example, integrated circuit chips are now being produced with electrical leads having a micron size of 0.10 microns. The integrated circuit chips are disposed on printed circuit boards and are electrically interconnected on the printed circuit boards. As a result, as the micron size of the electrical leads in the printed circuit boards decreases, either the size of the printed circuit boards can be decreased or additional circuitry can be provided on a board of a given size.

Electrical equipments generally include a plurality of printed circuit boards. To provide a connection between a pair of different boards, an electrical connector is generally provided for each of the boards in the pair. The electrical connectors are then interconnected to produce the desired circuitry. The use of a pair of electrical connectors to interconnect the printed circuit boards is wasteful of space and is also wasteful of electrical energy. It also requires additional components to be used, thereby increasing the cost of the assembly.

BRIEF DESCRIPTION OF A PREFERRED EMBODIMENT OF THE INVENTION

In a preferred embodiment of the invention, an electrical connector includes a conductive casing and a conductive probe disposed within the casing. The probe may be in a concentric relationship with the casing. The probe is insulated from the casing by a first insulating sleeve which may be disposed in a concentric relationship with the casing and the probe.

A first electrical assembly such as a first printed circuit board has an opening for a disposition of the casing in the opening in the board in an insulated relationship with the casing. A first end of the probe may pass through an opening in the first sleeve for connection to a terminal external to the connector.

A second end of the probe may pass through an opening in a second insulating sleeve disposed in the casing and may then pass through an opening in a second electrical assembly such as a second printed circuit board in an insulated relationship to the casing. A plug maybe disposed within the casing to position the second insulator fixedly within the casing. One of the printed circuit boards may be a motherboard and the other board may be a daughterboard. One of the boards may be in a transverse relationship to the other board.

DETAILED DESCRIPTION OF A PREFERRED EMBODIMENT OF THE INVENTION

Figure 1:
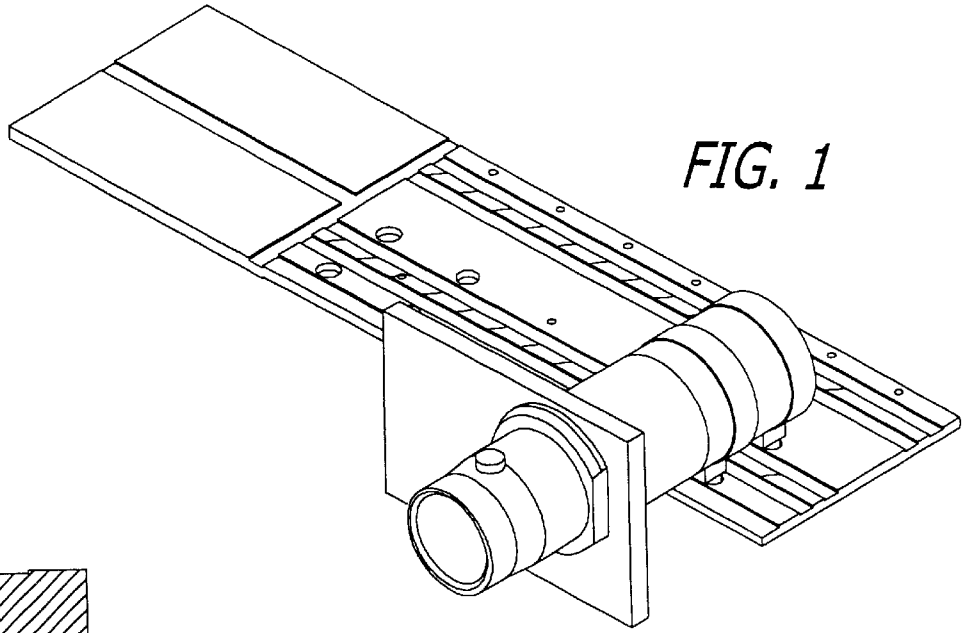
FIG. 1 is a perspective view of a preferred embodiment of an assembly including an electrical connector and first and second printed circuit boards mounted on the connector.
Figure 3:
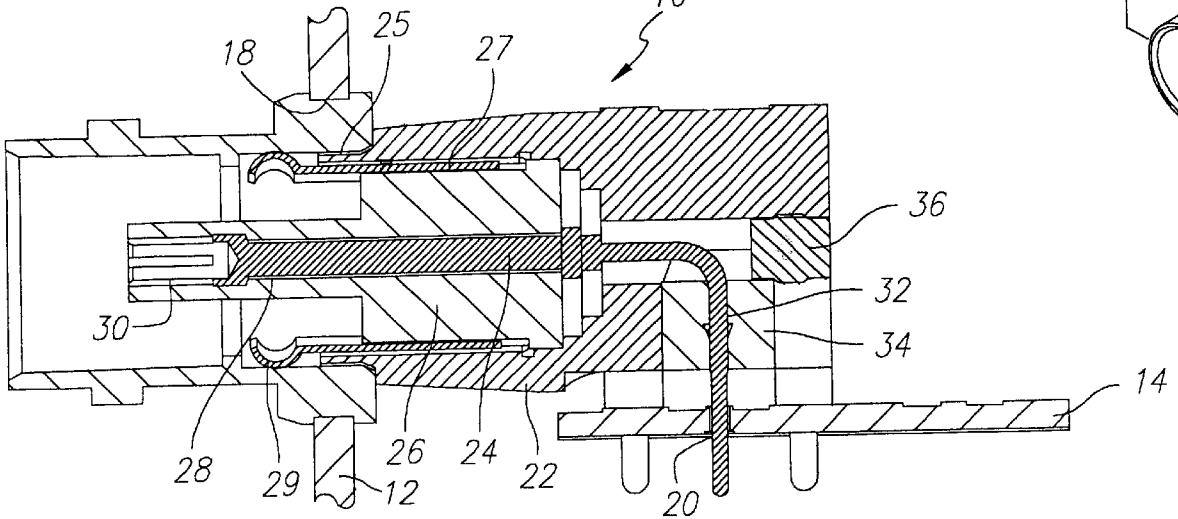
FIG. 3 is a sectional view of the preferred embodiment of the invention.
Figure 2:
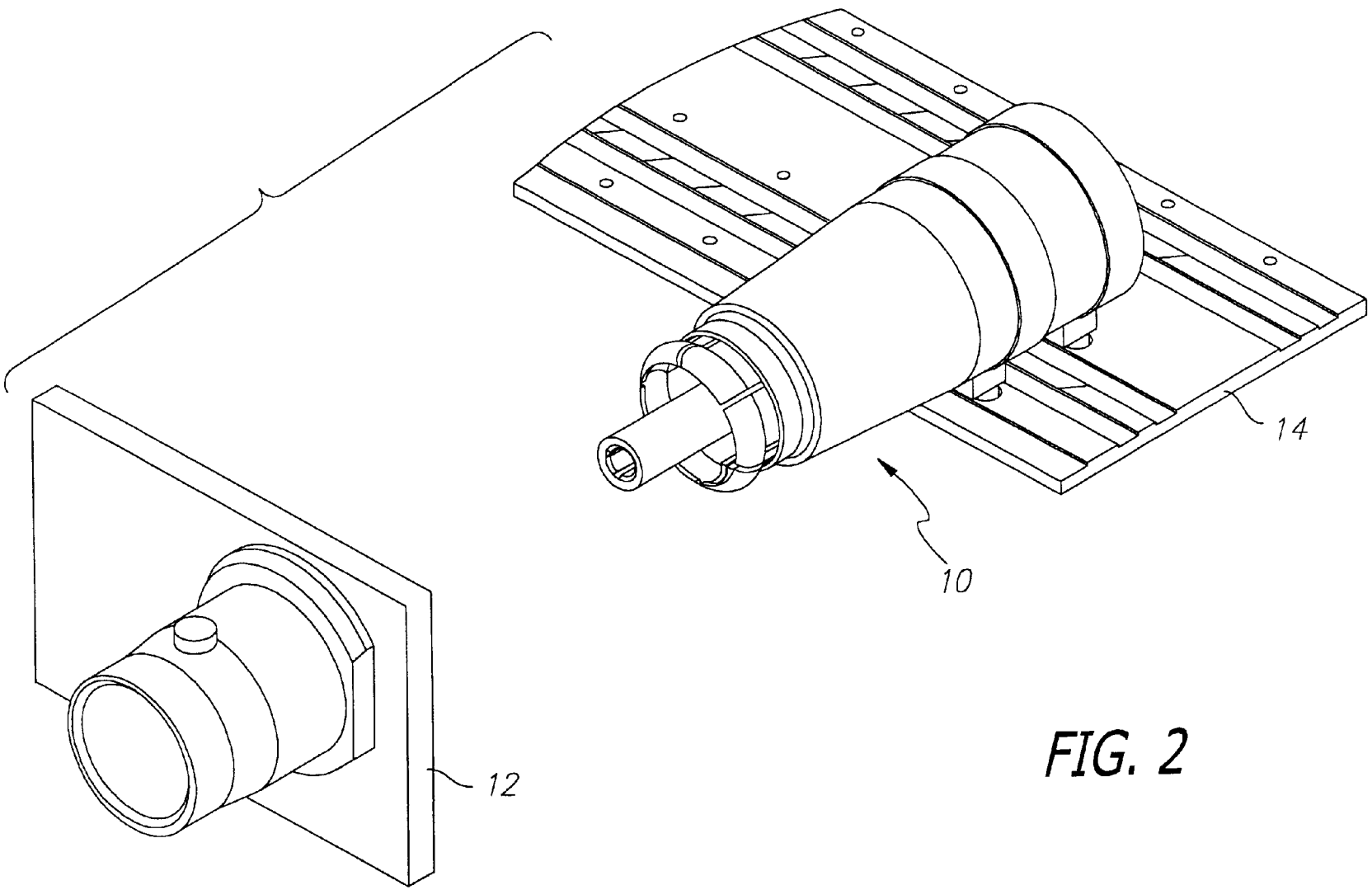
FIG. 2 is an exploded perspective view of the preferred embodiment of the invention as seen from a position corresponding to the position shown in FIG. 1.

An electrical connector generally indicated at 10 is associated with other members or assemblies such as a first printed circuit board 12 and a second printed circuit board 14. One of the boards may be a motherboard and the other board may be a daughterboard. For example, the printed circuit board 12 may be a motherboard and the printed circuit board 14 may be a daughterboard. The board 12 may be provided with a hole or aperture 18 and the board 14 may also be provided with a hole or aperture 20. The printed circuit boards 12 and 14 are shown only by way of illustration since other members and assemblies such as integrated circuit chips and other assemblies other than on printed circuit boards may be used without departing from the scope of the invention.

The electrical connector 10 includes an electrically conductive casing 22 and an electrically conductive terminal or probe 24. For the purposes of the claims, the casing 22 and the probe 24 may be considered as electrical terminals. The casing 22 is disposed in the hole 18 in the board 12 in an electrically insulating relationship with the board.

A casing extension 25 disposed within the opening 18 in the printed circuit board 12 and preferably made from an electrically conductive material is disposed adjacent a shelf in the casing 22 and is electrically coupled to the casing by electrically conductive fingers.,27 which are provided with spring-like characteristics at the end contiguous to the :casing extension 25. The fingers 27 are provided with expandable radii 29 at their spring ends to []assure continuity with the casing extension 25 and the counterpart casing 22.

The probe 24 may be disposed in a spaced and concentric relationship with the casing 22. An insulating sleeve 26 is disposed between the casing 22 and the probe 24 in a concentric relationship With the casing and the probe. The insulating sleeve 26 may have an axial opening 28. One end of the probe 24 extends axially through the opening 28 in the insulating sleeve 26 and through the board 12, preferably in a direction substantially perpendicular to the board. The probe 24 has a coupling member 30 at one end for connection to an electrically conductive terminal or lead (not shown). The electrically conductive terminal or lead (not shown) may be connected to a component (not shown) on the printed circuit board 12.

The second end of the probe 24 extends through an axially disposed opening 32 in an insulating sleeve 34. The sleeve 34 is disposed in the casing 22. The disposition of the insulating sleeve 34 in the casing 22 may be in a transverse relationship to the disposition of the sleeve 26 in the casing or it may be in a direction substantially parallel to the sleeve 26. The sleeve 34 may be retained in position in the casing 22 by a plug 36 which is disposed in the casing and which is preferably made from a conductive material. The second end of the probe 24 preferably extends through the opening 32 in the sleeve 34 in a direction substantially perpendicular to the disposition of the board 14. The board 14 may be disposed in contiguous relationship to the connector 10. The second end of the probe 24 may be connected to a component (not shown) on the printed circuit board 14.

The preferred embodiment shown in the drawings and described above has certain important advantages. It provides for an interrelationship between the boards 12 and 14 through only a single connector-namely the connector 10. This interrelationship is facilitated by the inclusion of the insulating sleeve 26 for guiding the passage of the first end of the probe 24 through the sleeve at a position near the board 12 and the inclusion in the connector 10 of the sleeve 34 for guiding the passage of the second end of the probe through the sleeve at a position near the board 14. This minimizes the space occupied by the assembly including the boards 12 and 14 and also minimizes the number of components in the assembly, thereby minimizing the cost of the assembly and the power consumed by the assembly. It also provides for the extension of the opposite ends of the probe 24 in the connector 10 through the openings 18 and 20 respectively in the printed circuit boards 12 and 14 and for the possible connection of the ends of the probe to electrical components in the boards 12 and 14.

Although this invention has been disclosed and illustrated with reference to particular embodiments, the principles involved are susceptible for use in numerous other embodiments which will be apparent to persons of ordinary skills in the art. The invention is, therefore, to be limited only as indicated by the scope of the appended claims.

What is claimed is:

1. In combination;

a connector having first and second conductive terminals disposed in insulated relationship to each other, a first electrical assembly disposed in a co-operative and insulated relationship with the first terminal and having an opening for the passage of the first and second terminals through the opening, a second electrical assembly disposed in a co-operative and insulated relationship with the second terminal and having an opening for the passage of the second terminal through the opening, an electrically conductive extension of the first terminal, the conductive extension being disposed in the opening in the first electrical assembly, and a spring member disposed between the first terminal and the electrically conductive extension of the first terminal for maintaining an electrically conductive relationship between the first terminal and the extension of the first terminal.

2. In combination, a connector having first and second conductive terminals disposed in an insulated and concentric relationship to each other, a first electrical assembly disposed in a co-operative and insulated relationship with the first terminal and having an opening for the passage of the first and second terminals through the opening, and a second electrical assembly disposed in a co-operative and insulated relationship with the second terminal and having an opening for the passage of the second terminal through the opening, the first terminal in the connector constituting a casing and the second terminal in the casing constituting a probe, a first electrical insulator disposed between the first and second terminals in the connector in a concentric relationship with the first and second terminals, there being an opening in the first electrical insulator for the passage of the second terminal through the opening at a first end of the first terminal, a second electrical insulator disposed within the casing in a concentric relationship with the probe at the second end of the probe, and there being an opening in the second electrical insulator for the passage of the second terminal through the opening in the second electrical insulator at a second end of the first terminal opposite to the first end of the first terminal, a plug disposed in the casing at a position near the second end of the probe for maintaining the second electrical insulator in a fixed relationship within the casing, an electrically conductive extension of the first terminal, the conductive extension being disposed in the opening in the first electrical assembly, and a spring member disposed between the first terminal and the extension of the first terminal for maintaining an electrically conductive relationship between the first terminal and the extension of the first terminal.

3. In a combination first and second electrical assemblies, one of the electrical assemblies constituting a motherboard and the other electrical assemblies constituting a daughterboard, a connector including a casing and a probe disposed within the casing in insulated relationship to the casing, the first electrical assembly being disposed on the casing of the connector, and the second electrical assembly being disposed relative to the probe in the connector for passage of the probe through the second electrical assembly, the probe having first and second ends, an electrical insulator disposed between the casing and the probe for maintaining the casing and the probe in an insulated and concentric relationship to each other, the first end of the probe extending through the electrical insulator and being constructed to be connected to an electrical terminal at the first end, an electrically conductive extension of the casing disposed in contiguous relationship to the casing, and a spring member disposed between the casing and the extension of the casing for maintaining an electrical conductivity between the casing and the extension of the casing.

4. In combination, first and second electrical assemblies, one of the electrical assemblies constituting a motherboard and the other electrical assemblies constituting a daughterboard, a connector including a casing and a probe disposed within the casing in insulated relationship to the casing, the first electrical assembly being disposed on the casing of the connector, the second electrical assembly being disposed relative to the probe in the connector for passage of the probe through the second electrical assembly, the probe having first and second ends, a first electrical insulator disposed between the casing and the probe for maintaining the casing and the probe in an insulated and concentric relationship to each other, the first end of the probe extending through the first electrical insulator and being constructed to be connected to an electrical terminal at the first end, the second electrical assembly having an opening, a second electrical insulator supported by the casing and having an opening for passage of the probe through the opening in the second electrical insulator and the opening in the second electrical assembly, the first electrical assembly constituting a first printed circuit board and the second electrical assembly constituting a second printed circuit board, an electrically conductive extension of the casing disposed in contiguous relationship to the casing, and a spring member disposed between the casing and the extension of the casing for maintaining an electrical conductivity between the casing and the extension of the casing.

5. In combination, first and second electrical assemblies, a connector including a conductive casing and a conductive probe and a first insulating sleeve disposed between the casing and the probe, a first end of the probe extending through the casing, the first insulating sleeve and the first electrical assembly in an insulated relationship to the casing and the first electrical assembly, the first electrical assembly being disposed on the casing in electrically insulated relationship to the casing, a second insulating sleeve disposed within the casing, the second end of the probe extending through the second sleeve and the second electrical assembly in an insulated relationship to the casing and the second electrical assembly, the first electrical assembly being disposed in a transverse relationship to the second electrical assembly, an extension of the casing, the extension being disposed in a contiguous relationship to the casing, a spring member disposed between the casing and the extension of the casing to maintain the extension of the casing in an electrically conductive relationship with the casing, and the extension of the casing being disposed in the opening in the first electrical assembly.

6. In combination, a connector including a conductive casing and a conductive probe and a first insulating sleeve disposed between the casing and the probe, a first end of the probe extending in a first direction through the conductive casing and the first insulating sleeve for coupling to a first electrical assembly and a second end of the probe extending in a transverse relationship to the first end of the probe, a second insulating sleeve disposed between the casing and the second end of the probe in the transverse relationship to the first insulating sleeve, the second end of the probe extending in the transverse relationship through the second insulating sleeve for coupling to a second electrical assembly, a plug disposed in the casing relative to the second insulating sleeve for retaining the second insulating sleeve in the transverse relationship between the casing and the second end of the probe, and a conductive casing extension disposed within the casing and including fingers extending beyond the casing in electrically conductive relationship to the casing for coupling to the first electrical assembly, there being in the first insulating sleeve an opening in the transverse relationship to the opening in the first insulating sleeve and the second end of the probe extending through the opening in the second insulating sleeve in a concentric relationship with the second insulating sleeve.

* * * * *